US005366593A

United States Patent [19]

Lee et al.

[11] Patent Number: 5,366,593

[45] Date of Patent: Nov. 22, 1994

[54] BLEACHING OF LIGNOCELLULOSIC MATERIAL WITH IN-SITU-GENERATED DIOXIRANE

[75] Inventors: Chung-Li Lee, Vancouver, Canada; Robert W. Murray, St. Louis, Mo.; Kenneth Hunt, West Vancouver, Canada; James T. Wearing, Vancouver, Canada; Robert M. Hogikyan, Burnaby, Canada; Colin W. Oloman, Vancouver, Canada; Jianxin Chen, North Vancouver, Canada

[73] Assignees: Pulp & Paper Research Institute of Canada, Pointe Claire, Canada; The Curators of the University of Missouri, Columbia, Mo. ; a part interest

[21] Appl. No.: 927,164

[22] Filed: Aug. 11, 1992

Related U.S. Application Data

[63] Continuation-in-part of Ser. No. 653,639, Feb. 12, 1991, abandoned.

[51] Int. Cl.[5] ..... D21C 3/20; D21C 9/16

[52] U.S. Cl. ..... 162/72; 162/76; 162/78; 162/82

[58] Field of Search ..... 162/72, 82, 76, 78, 162/77, 65; 8/111

[56] References Cited

U.S. PATENT DOCUMENTS 3,822,114 7/1974 Montgomery ..... 8/11
4,404,061 9/1983 Cael ..... 162/78

OTHER PUBLICATIONS

Adam et al., "Dioxirane Epoxidation of alpha, beta-Unsaturated Ketones", Chem. Ber. 124 (1991), 227-232.
Edwards et al., "On the Formation and Reactivity of Dioxirane Intermediates in the Reaction of Peroxoanions with Organic Substrates," Photochem. and Photobiol., vol. 10, pp. 63-70 (1979).
Zabrowski et al., "The Oxidation of Aromatic Amines in the Presence of 'Electron-Rich' Aromatic Systems," Tetrahedron Letters, vol. 29, No. 36, pp. 4501-4504 (1988).
SINGH, "The Bleaching of Pulp", Tappi Press, Atlanta, Ga. 1979, pp. 305-314.
Montgomery, "Catalysis of Peroxymonosulfate Reactions by Ketones," J. Amer. Soc., vol. 96, No. 25, pp. 7820, 7821 (1974).
Murray et al., "Dioxiranes: Synthesis and Reactions of Methyldioxiranes," J. Org. Chem. 1985, 50, 1847-2853.

*Primary Examiner*—Steve Alvo
*Attorney, Agent, or Firm*—Millen, White, Zelano & Branigan

[57] ABSTRACT

A chemical pulp which contains reactants capable of generating dioxirane within the pulp is produced in a process which comprises mixing a pulp with reactants comprising a carbonyl compound, preferably acetone, and an oxygen donor, preferably monoperoxysulfate, in proportions which produce a water-soluble dioxirane having a molecular diameter of less than 140 angstrom units. Such a pulp bleaching process which employs dioxirane as a bleaching agent is rendered environmentally and economically acceptable by recycling the reactants employed to produce the dioxirane.

35 Claims, 8 Drawing Sheets

BLEACHING OF LIGNOCELLULOSIC MATERIAL WITH IN-SITU-GENERATED DIOXIRANE

BACKGROUND OF THE INVENTION

This invention relates to a process of bleaching a chemical pulp and to the pulp. This is a continuation-in-part of Ser. No. 07/653,639, filed Feb. 12, 1991, now abandoned.

For the last three decades, chemical pulps, particularly those produced by the kraft process, nave been bleached to the brightness level required for market pulps, about 90% Elrepho, by conventional processes such as CEDED, where C stands for chlorination, E for caustic extraction, and D for chlorine dioxide treatment. Effluents from these conventional bleaching processes cannot be concentrated and burned in a kraft recovery boiler due to their high content of chlorinated organic material, typically about five kilograms per air-dried ton of pulp. Instead, these mill effluents have to be post-treated and discharged into waterways.

In response to the need for reducing the adverse impact of pulp mill effluents on the environment, technologies to reduce the use of elemental chlorine in chemical pulp bleaching have been evaluated and many retrofitted, where feasible, into pulp mills. These technologies are: (1) modified continuous cooking (MCC); (2) rapid displacement heating (RDH); (3) delignification and (4) high chlorine dioxide substitution. The first three methods reduce the residual lignin content in the pulp to the chlorination stage. The fourth method is a direct substitution of elemental chlorine by chlorine dioxide to reduce the elemental chlorine charge. The aforementioned technologies available today have the object of reducing the use of elemental chlorine. However, the complete elimination of elemental chlorine in the bleaching of chemical pulps is highly desirable.

Co-pending application PCT/CA90/00052 teaches the use of dioxiranes in pulp bleaching. However, the process of the co-pending application, although producing excellent results in bleaching, can be inefficient in the generation of dioxirane. The published method for the preparation of isolated dioxirane [Murray, R. W. and Jeyaraman, R., J. Org. Chem. 50, 2847, 1985] is not practical for large-scale production. For this reason, in-situ-generated dimethyldioxirane was employed to oxidize aromatic amines under phase-transfer conditions using only a slight excess of monoperoxysulfate to complete the required oxidation transformation [Zabrowski, D. L., Moormann, A. E. and Beck, Jr. K. R., Tetrahedron Letters, 29, (36):4501, 1988]. Montgomery, R. E. reported that, ketones catalyzed a number of reactions with monoperoxysulfate [Montgomery, R. E., J. Amer. Chem. Soc., 96, (25): 7820, 1974]. U.S. Pat. No. 3,822,114 to Montgomery R. E. discloses a bleaching process for activation of peroxygen bleaching agents which comprises conjointly dissolving in aqueous solution containing peroxygen bleaching agents, certain aldehyde or ketone bleaching activators, and buffering compounds. Montgomery's process is applied to the instant bleaching activation process for the purpose of bleaching stains on fabrics and hard surfaces and for reducing dye transfer in conventional laundering solutions.

The present invention seeks to improve the above-described prior process by providing economies in the use of the dioxirane bleaching agents. These bleaching agents are, generically, designated hereinafter as "A", for "Activated-oxygen bleaching agent", and "$DMD_{isg}$", for a preferred dioxirane, viz., in situ generated dimethyl dioxirane.

To implement the above-described activated oxygen beaching on a precursor, monoperoxysulfate, an efficient recovery of the spent chemical,s ketone and sulfate, and a good chemical balance in pulping, bleaching and recovery processes in a mill.

Heretofore the monoperoxysulfate has been produced by several methods. One method is in the reaction of hydrogen peroxide (35–100%) with either concentrated or fuming sulfuric acid, as disclosed in U.S. Pat. No. 3,900,555. This method requires an excess amount of sulfuric acid which has to be neutralized and results in a large amount of dead sulfate salt, along with the monoperoxysulfate.

According to U.S. Pat. No. 2,955,020, another method for generating monoperoxysulfate, with a minimum of sulfate byproduct, is the reaction of the persulfate with concentrated hydrogen peroxide (>50%) in the presence of a small amount of sulfuric acid. This method effectively incorporates both oxygen atoms in hydrogen peroxide into monoperoxysulfate in high yield.

According to U.S. Pat. No. 3,915,816, persulfate can be generated via direct electrosynthesis. Sodium sulfate and sulfuric acid are mixed and fed to an electrochemical cell where the solution is electrolyzed to form sodium persulfate. The sodium sulfate is then recycled to the feed. As a result almost pure sodium persulfate can be generated. Similar direct electrosynthesis processes are described in U.S. Pat. No. 4,144,144 which uses a neutral analyte of sodium and ammonium sulfates and in U.S. Pat. No. 4,310,394 which employs a cation exchange membrane as a cell separator.

Other patented methods for the generation of monoperoxysulfate are, for example, the aeration of sulfite in the presence of cupric ion (U.S. Pat. No. 4,756,800) and the hydrolysis of the persulfate (U.S. Pat. No. 4,049,786).

If the effluent is recycled to the pulp mill, the extra sodium sulfate added to the system would eventually increase the sulfidity of the pulping chemicals in an unacceptable manner. Consequently, recovery process steps are required, in addition an effective generation of monoperoxysulfate, in order to achieve an acceptable chemical balance in a mill using activated oxygen bleaching.

There is no existing technology proven on an industrial scale that can close the bleached pulp mill operation via internal recycle or by external treatment of the bleached effluents. Effluents from existing bleaching processes contain a large amount of chlorinated organics and tend to accumulate a large amount of chloride upon recycling. This inhibits the possibility of concentrating and burning the effluents in the kraft recovery boiler. The concept of closing bleached pulp mill operations and the elimination of all contaminated effluent was originally proposed in 1967 by Howard W. Rapson. Pulp & Paper Canada, Vol. 68, No. 12:T-635. The closed-cycle operation was abandoned due to the occurrence of high corrosion rates and other operating problems. A more effective way to approach this problem is to completely eliminate the use of chlorine and chlorine containing compounds for pulp bleaching.

U.S. Pat. Nos. 5,061,343, 5,034,094, and 5,022,962 are related generally to recovery of chemicals. In U.S. Pat.

No. 5,061,343, which relates to the recovery of NaOH and other values from spent liquors and bleach plant effluents, one example shows the calculated energy benefit for treating 10% of the weak black liquor stream for a 95% sodium recovery.

The implementation of Activated Oxygen bleaching without any recovery system would impose environmentally unacceptably high BOD loadings on the effluent treatment system. For example, at a 1.2% A.O. charge there will be 26 kg/ADT BOD loading from acetone discharged to the effluent treatment system vs the designed BOD discharge capacity at about 7–15 kg/ADT in most existing treatment systems. Consequently, Activated Oxygen bleaching is not industrially viable on a mill scale without the recovery system aspect of this invention.

A similar technical problem was also found in the capacity limitation of recovery boilers. The approach employed in U.S. Pat. No. 5,034,094 was to solve the limitation of recovery boiler capacity problem by employing combinations of well known process units to treat some of the black liquor separately.

In addition, the spent sulfate, a byproduct of Activated Oxygen bleaching will also be environmental unacceptably high. The complete recycle of the Activated Oxygen bleaching effluent to the recovery boiler in an integrated mill without removal of sulfate or reduction of sulfate formation in the generation of Activated Oxygen bleaching agent, although technically feasible, will cause unacceptable sodium and sulfidity imbalances in the existing pulping process.

The major technical impediments for the implementation of Activated Oxygen bleaching in an industrial scale are apparent. First, without direct recycle of the carbonyl compound, the BOD loading at 1.2% A.O. charge would be at an unacceptable level, viz., 26 kg/ADT. Second, salt cake formation would be at an unacceptably high level and, if monoperoxysulfate and hydrogen peroxide are employed as the oxygen donor, the sulfidity of an existing pulping process would be upset.

OBJECTS OF THE INVENTION

An object of the present invention is to provide a chemical pulp that contains reactants able to generate a dioxirane within the pulp.

Another object of this invention is to provide a process of bleaching a chemical pulp that comprises mixing the pulp with reactants in a manner which generates a dioxirane within the pulp.

Another object is to provide means to economically generate the required bleaching chemicals and to recover the spent bleaching chemicals while avoiding the problems of excess accumulation of sodium and sulfur salts.

Yet another object is to provide means for completely recovering the bleaching effluent.

Upon further study of the specification and appended claims, further objects and advantages of this invention will become apparent to those skilled in the art.

SUMMARY OF THE INVENTION

In a product aspect, this invention relates to a chemical pulp that contains reactants capable of generating a dioxirane within the pulp.

In one process aspect, this invention relates to a process of bleaching a chemical pulp that comprises the step of mixing the pulp with reactants capable of generating a dioxirane within the pulp.

In another process aspect, this invention relates to a process of bleaching a chemical pulp with a dioxirane wherein one or more of the spent chemicals from the bleaching step is recovered and reused.

DETAILED DISCLOSURE

In a preferred aspects, the pulp of this invention is further characterized by one or more of the following:

a) the reactants therein comprise a carbonyl compound and an oxygen donor in proportions suitable to produce a water-soluble dioxirane having a molecular diameter of less than 140 angstrom units;
b) the dioxirane has a molecular diameter of less than about 50 angstrom units;
c) the carbonyl compound is a ketone, preferably a lower aliphatic ketone, e.g., of 3–8 carbon atoms, e.g., acetone, methyl ethyl ketone, a butane-2-one or -3-one, a pentane-2-one or -3-one, a hexane-2-one or -3-one, a cyclic ketone, e.g., cyclohexanone, and most preferably is acetone;
d) or an aldehyde, which preferably is acetaldehyde;
e) the dioxirane is dimethyldioxirane;
f) the oxygen donor is a monoperoxysulfate;
g) the oxygen donor is selected from the group consisting of peroxymonocarbonate, peracetic acid, perboric acid, perphosphoric acid, perbenzoic acid and their peroxy derivatives;
h) the pulp has been further bleached with a non-chlorine containing compound;
i) the pulp contains less than 120 parts per million (ppm) chlorine element content;
j) the pulp has a viscosity of at least 20 mPa.s;
k) the pulp has a brightness of at least about 70% Elrepho; and
l) the pulp has a Kappa number of about 4.

In its preferred aspects, the in situ dioxirane oxidation process of this invention is characterized by one or more of the following:

a) the reactants comprise a carbonyl compound and an oxygen donor in proportions which produce a water-soluble dioxirane having a molecular diameter of less than 140 angstrom units;
b) the dioxirane has a molecular diameter of less than about 50 angstrom units;
c) the carbonyl compound is a ketone, preferably acetone;
d) the carbonyl compound is an aldehyde, preferably acetaldehyde;
e) the carbonyl compound is impregnated into a pulp slurry followed by the application of the oxygen donor;
f) the carbonyl compound and the oxygen donor are applied to the pulp simultaneously;
g) the carbonyl compound is acetone, which is added in the amount of at least about 4% by weight based on oven-dried pulp;
h) the oxygen donor is a monoperoxysulfate;
i) the oxygen donor is selected from peroxymonocarbonate, peracetic acid, perboric acid, perphosphoric acid, perbenzoic acid and their peroxy derivatives;
j) the oxygen donor is added in a series of stages;
k) the process includes the additional step of carrying out a caustic extraction on the pulp using sodium hydroxide in an amount from 0.5 to 5% by weight based on oven-dried pulp;

l) the aforesaid process with the additional step in which the dioxirane treatment and caustic extraction are applied sequentially in a multi-stage sequence;

m) the aforesaid multistage process in which the sequence is $A_1$-$E_1$-$A_1$-$E_2$, where A indicates a bleaching stage using in situ-generated dimethyldioxirane, in which $A_1$ means a first in situ generated dioxirane oxidation stage; $E_1$ means a first extraction stage, $A_2$ means a second in situ dimethyldioxirane oxidation stage; and $E_2$ means a second extraction stage;

n) the dioxirane is generated in an amount sufficient to provide an active oxygen charge within the pulp varying from 0.2 to 4.0% by weight based on oven-dried pulp;

o) the process conducted while the pulp is at a temperature within the range from 20° to 80° C.;

p) the pH of the pulp is within the range from 6.5 to 8;

q) a pH of 6.5 to 8 is reached in the pulp by the addition thereto of sodium bicarbonate;

r) a pH of 6.5 to 8 is reached in the pulp by the addition thereto of sodium carbonate, sodium hydroxide, sodium acetate or a buffer;

s) the pulp is at a consistency in the range from 3 to 35%;

t) the process is carried out in combination with oxygen delignification, either before or after the oxygen delignification;

u) one or more additional bleaching steps employing a different bleaching agent is carried out in sequence with the dioxirane treatment; and v) the bleaching agent for the aforesaid additional bleaching step is selected from chlorine dioxide, hydrogen peroxide, ozone and oxygen.

Regeneration and Recycle of Reactants

The regeneration and recycle aspect of the process of this invention enables the implementation of Activated Oxygen bleaching by providing effective means of recovering and regenerating the bleaching chemicals for reuse. The Activated Oxygen bleaching stage is found to generate ketone and sulfate (byproducts) in nearly stoichiometric equivalence to the charge of Activated Oxygen. Ketone is recovered in an enriched form or recirculated directly in the spent bleaching liquor to the Activated Oxygen bleaching stage. Sulfate is recovered from the bleaching effluent and converted by chemical or chemical and electrochemical means to monoperoxysulfate. The recovered ketone and regenerated monoperoxysulfate are then combined in the prior Activated Oxygen bleaching step to form Activated Oxygen.

The regeneration and recycle aspect of the present invention also provides a closed cycle for pulping and bleaching in which the spent bleaching effluent is recycled to an integrated pulp mill and the required monoperoxysulfate for bleaching is regenerated from sodium sulfate recovered from a pulp mill circuit, for example, from the precipitator catch or from the spent bleaching liquor.

The application of inorganic recovery via an electrochemical route to form peroxydisulfate followed by the chemical reaction of peroxydisulfate with hydrogen peroxide makes the generation of monoperoxysulfate more efficient than a method employing the reaction of sulfuric acid with hydrogen peroxide and reduces the salt cake formation by 60%. As a result, there is no upset in sulfidity in the existing pulping process and no excess salt cake to be discharged. In fact, sodium sulfate (about 90 kg/ADT) from the precipitator catch in some mills has a disposal problem and the use of this sodium sulfate to generate monoperoxysulfate for Activated Oxygen bleaching will eliminate the concern of sulfate disposal, enable the implementation of Activated Oxygen bleaching and still maintain sodium and sulfidity balance in the existing pulping process of an integrated mill.

The use of calcium hydroxide, which costs about one tenth that of sodium hydroxide, for neutralization of the monoperoxysulfuric acid in the monoperoxysulfate generation via the reaction of sulfuric acid with hydrogen peroxide will enable the process to remove unwanted sulfate from the system as high quality gypsum by-product. This is a technically viable means of implementing Activated Oxygen bleaching in situations where the electrochemical route is not feasible.

DETAILED DESCRIPTION OF THE DRAWINGS

Embodiment 1

Figure 1:
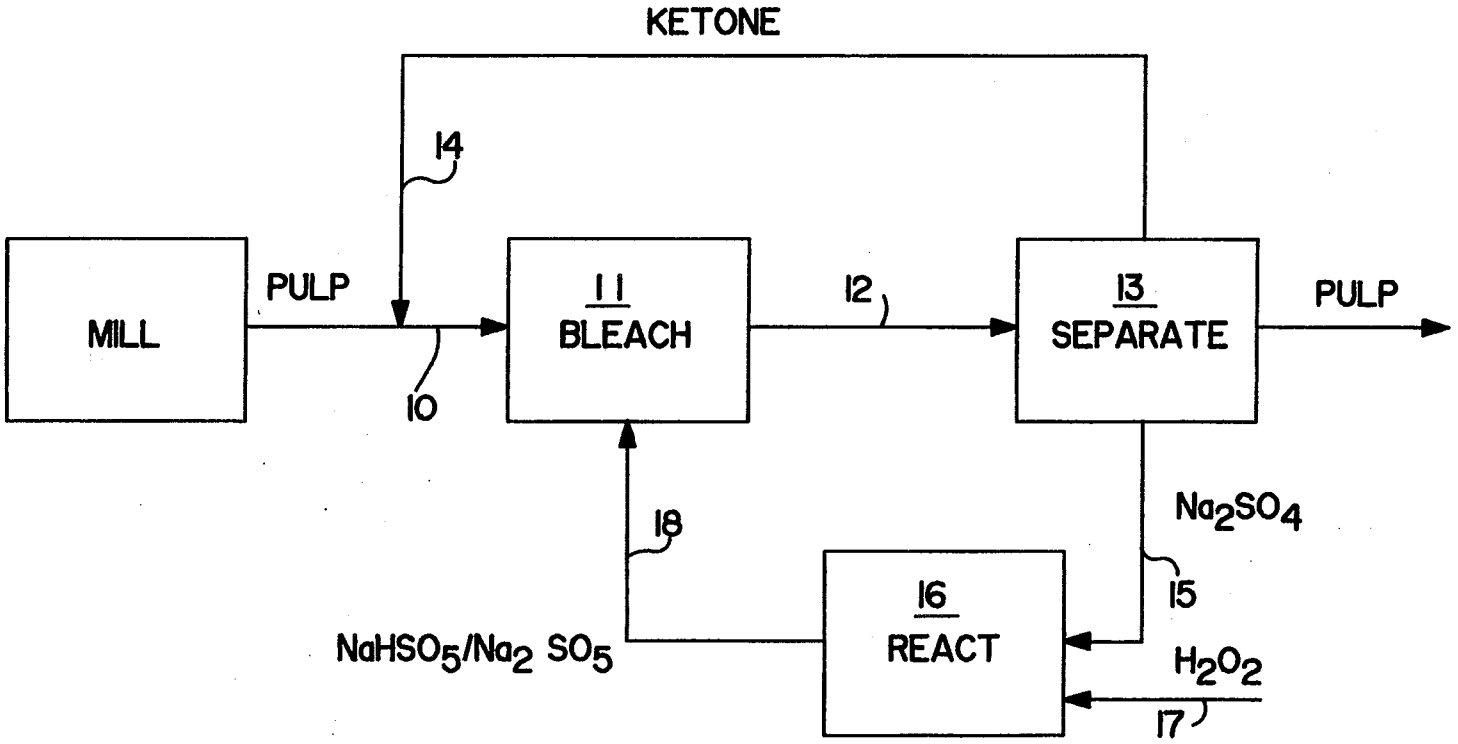
FIGS. 1–8 are flowsheet diagrams of illustrative embodiments of the reactants recovery and recycle aspect of the process of this invention.

FIG. 1 is a flowsheet of a process scheme where Activated Oxygen is generated from monoperoxysulfate through a separation of sulfate from bleaching effluent followed by a series of reactions involving hydrogen peroxide. Ketone-impregnated pulp in line 10 is fed into an Activated Oxygen bleaching stage 11. Monoperoxysulfate in the line 18 is fed into 11 in order to generate Activated Oxygen in situ and delignify the pulp. The pulp with spent bleaching liquor is then sent to a separation step 13, where the ketone and sulfate byproducts of the bleaching reaction are recovered. The ketone is recycled in stream 14 to impregnate the pulp. The sulfate is fed by line 15 to a reaction step 16, where hydrogen peroxide is fed by line 17 to generate monoperoxysulfate in line 18.

Embodiment 2

Figure 2:
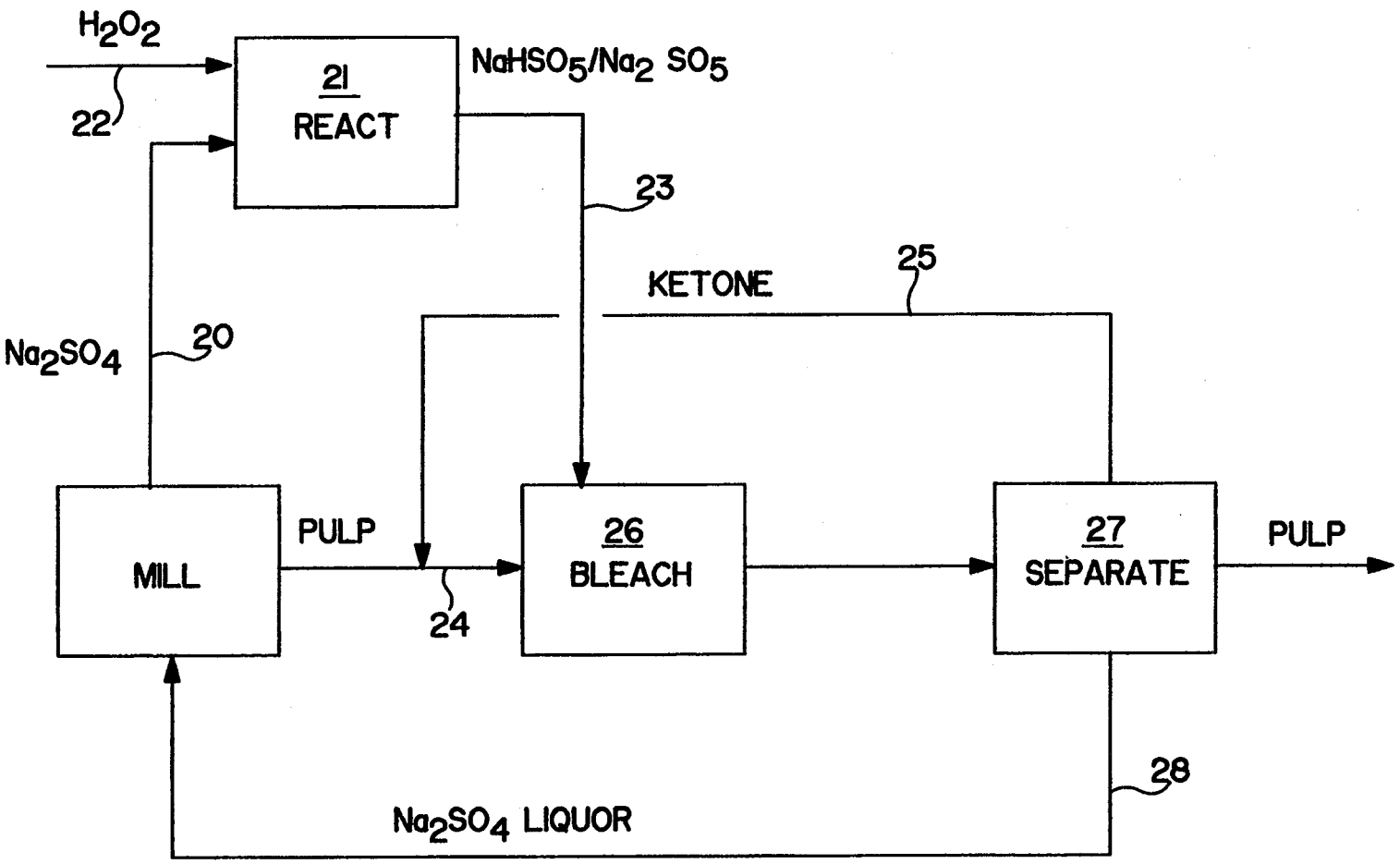

FIG. 2 is a flowsheet of a process scheme where the Activated Oxygen bleaching is integrated within a pulp mill operation in which sulfate is recovered from the kraft pulp mill and is fed through line 20 into a reaction step 21. Hydrogen peroxide is fed through line 22 to generate monoperoxysulfate. The monoperoxysulfate in line 23 is mixed with ketone-impregnated pulp (line 24) to form Activated Oxygen in situ. The pulp is retained in a bleaching stage 26 for a required time and is then fed into a separation step 27 where the ketone is recovered from the spent bleaching effluent. The recovered ketone is recycled through line 25 to impregnate the pulp. The sulfate-containing spent bleaching liquor in line 28 is recycled to the kraft mill recovery system to reclaim the sulfate, a byproduct from the Activated Oxygen bleaching.

Embodiment 3

Figure 3:
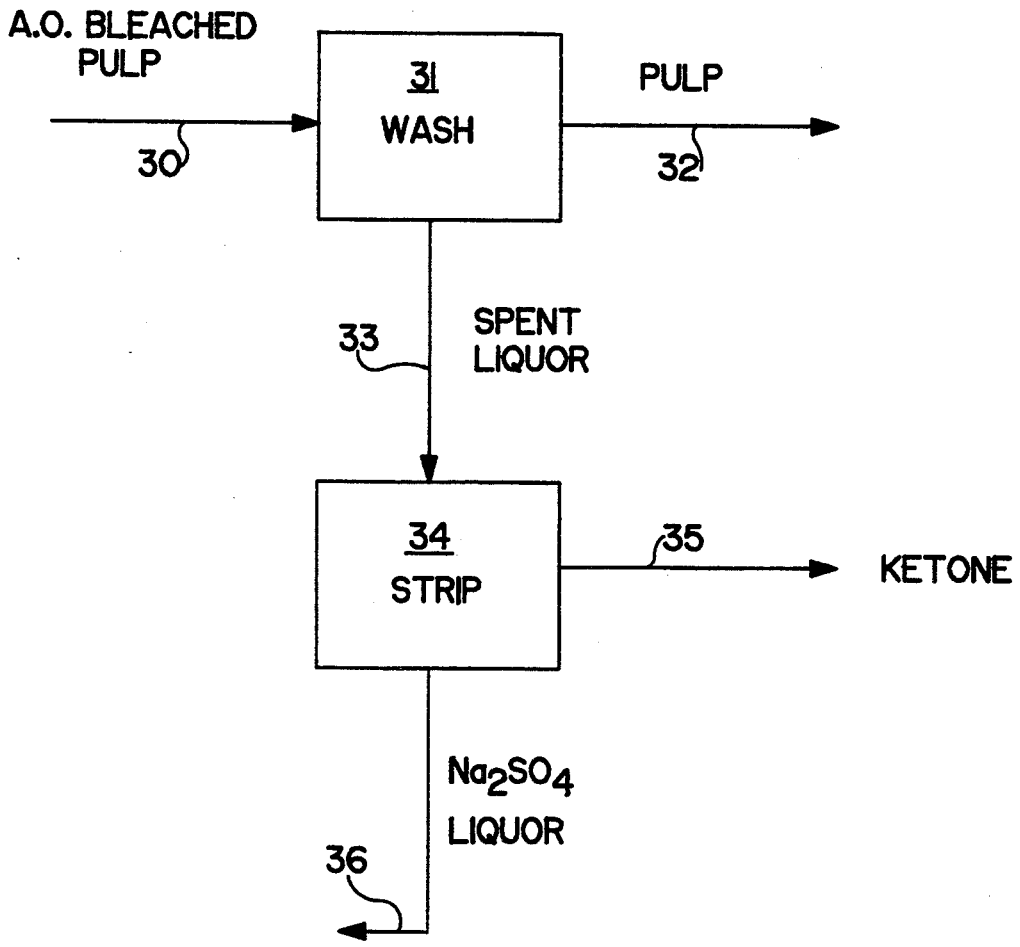

FIG. 3 is a flowsheet of the separation step mentioned in Embodiments 1 and 2. The Activated-Oxygen-bleached pulp in line 30 is fed into a washer 31 where the spent bleaching chemicals are displaced into line 33.

Washer 31 may be a pressure washer, in order to minimize ketone vapor loss. Clean pulp is discharged from line 32. The spent liquor in line 33 is introduced to unit 34 where ketone is enriched into line 35 and the remaining liquor to line 36. The process step of unit 34 may include steam stripping, distillation, gas stripping, membrane separation preparations, and preferably a steam stripping step.

Embodiment 4

Figure 4:
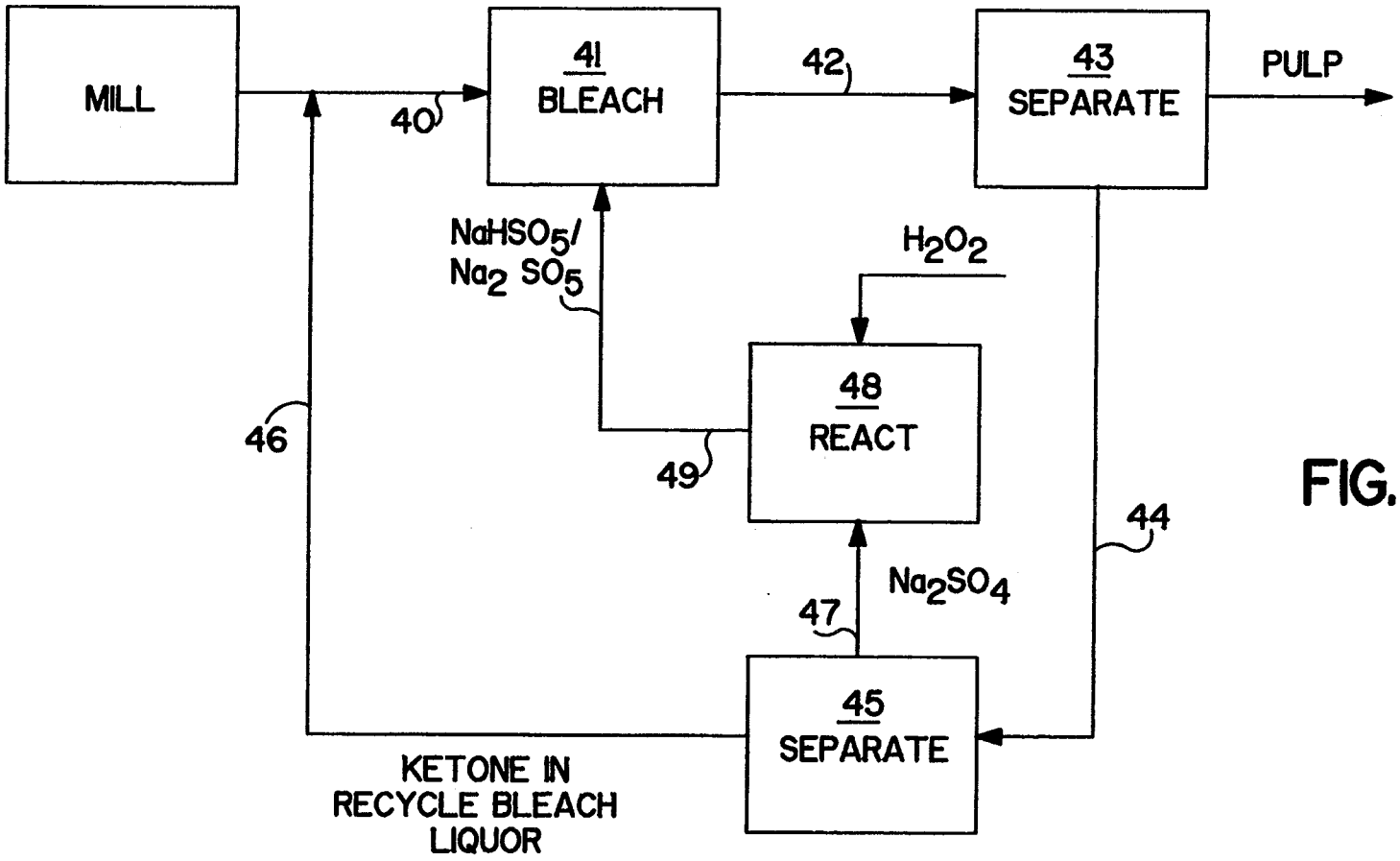

FIG. 4 is a flowsheet of a process in which sulfate is separated from the spent bleaching liquor and used to generate monoperoxysulfate while the ketone is returned to the Activated Oxygen bleaching stage in the recycled bleaching liquor. Ketone impregnated pulp in line 40 is fed to an Activated Oxygen bleaching stage 41. Monoperoxysulfate in line 49 is fed to generate Active Oxygen in situ and delignify the pulp. The spent bleaching liquor containing the ketone and sulfate is separated from the pulp in step 43. The spent bleaching liquor is then recycled by line 44 through a sulfate recovery step 45 and to the pulp by line 46. Separation of sulfate from the spent bleaching liquor in step 45 may be used to regenerate monoperoxysulfate in step 48.

Embodiment 5

Figure 5:
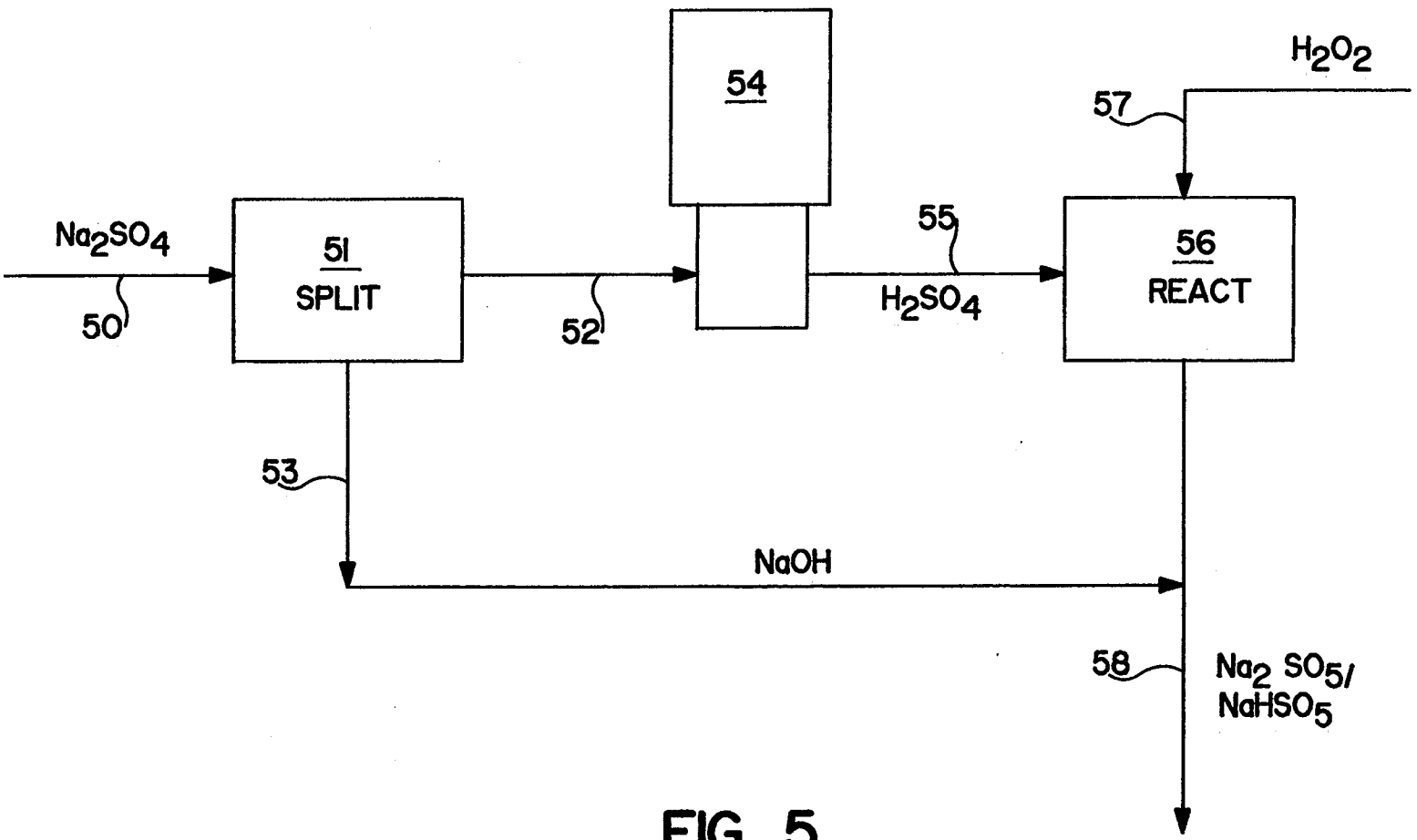

FIG. 5 is a flowsheet for chemical generation of monoperoxysulfate in the reaction step of embodiments 1, 2 and 4 in which sulfate is fed at line 50 into unit 51 where the sulfate is split into sulfuric acid and sodium hydroxide, lines 52 and 53, respectively. Unit 51 may be a bipolar membrane electrodialysis step. M. Paledogou et al., C.C.P.A. Ann. Mtg., 78A:A38, Jan. 28–29 (1992). The sulfuric acid is further concentrated in unit 54 and is fed through line 55 to a reactor 56. Unit 54 may be an evaporator. Hydrogen peroxide is introduced in line 57 and monoperoxysulfuric acid is generated according to U.S. Pat. No. 3,900,555 in the reactor 56. The sodium hydroxide in line 53 may be used to neutralize the monoperoxysulfuric acid from the reactor 56 to produce monoperoxysulfate in line 58. $Ca(OH)_2$ could also be used to neutralize the generated monoperoxysulfuric acid as illustrated in Example 6A.

Embodiment 6

Figure 6:
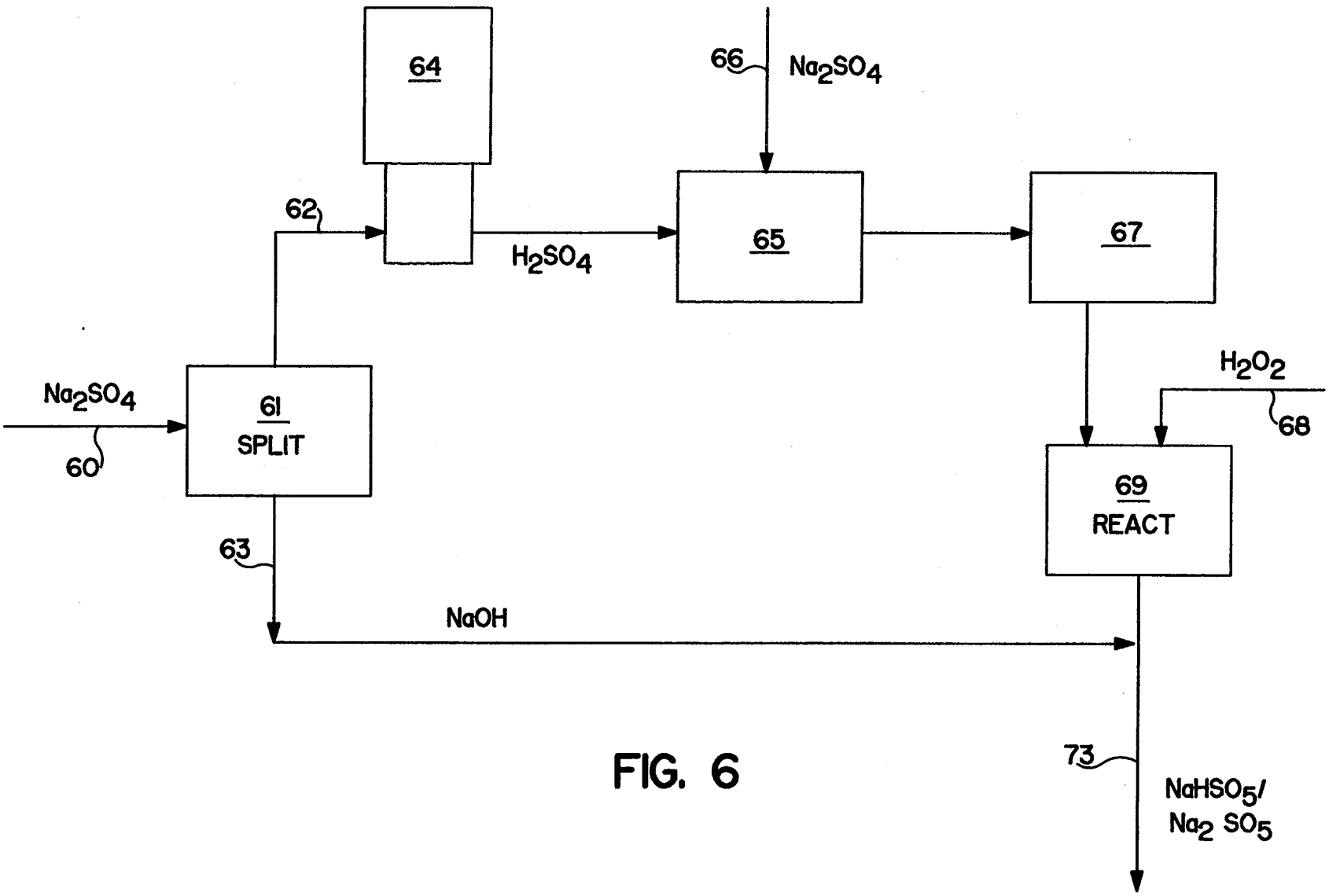

FIG. 6 is a flowsheet for electrochemical generation of monoperoxysulfate in the reaction step of Embodiments 1, 2 and 4. Sulfate is introduced in line 60 to a unit 61 where the sulfate is split into sulfuric acid and sodium hydroxide at lines 62 and 63, respectively. The sulfuric acid is further concentrated in unit 64 and is then sent to unit 65. Sulfate is added through line 66 to form bisulfate which is fed to unit 67. Unit 67 may be an electrochemical reactor where the bisulfate is transformed into peroxydisulfate according to U.S. Pat. No. 3,915,816. The peroxydisulfate is sent to react with hydrogen peroxide from line 68 to form monoperoxysulfuric acid according to U.S. Pat. No. 2,965,020 in reactor 69. The monoperoxysulfuric acid is then neutralized with the sodium hydroxide from line 63. The generated monoperoxysulfate is then delivered to the Activated Oxygen bleaching stage.

Embodiment 7

Figure 7:
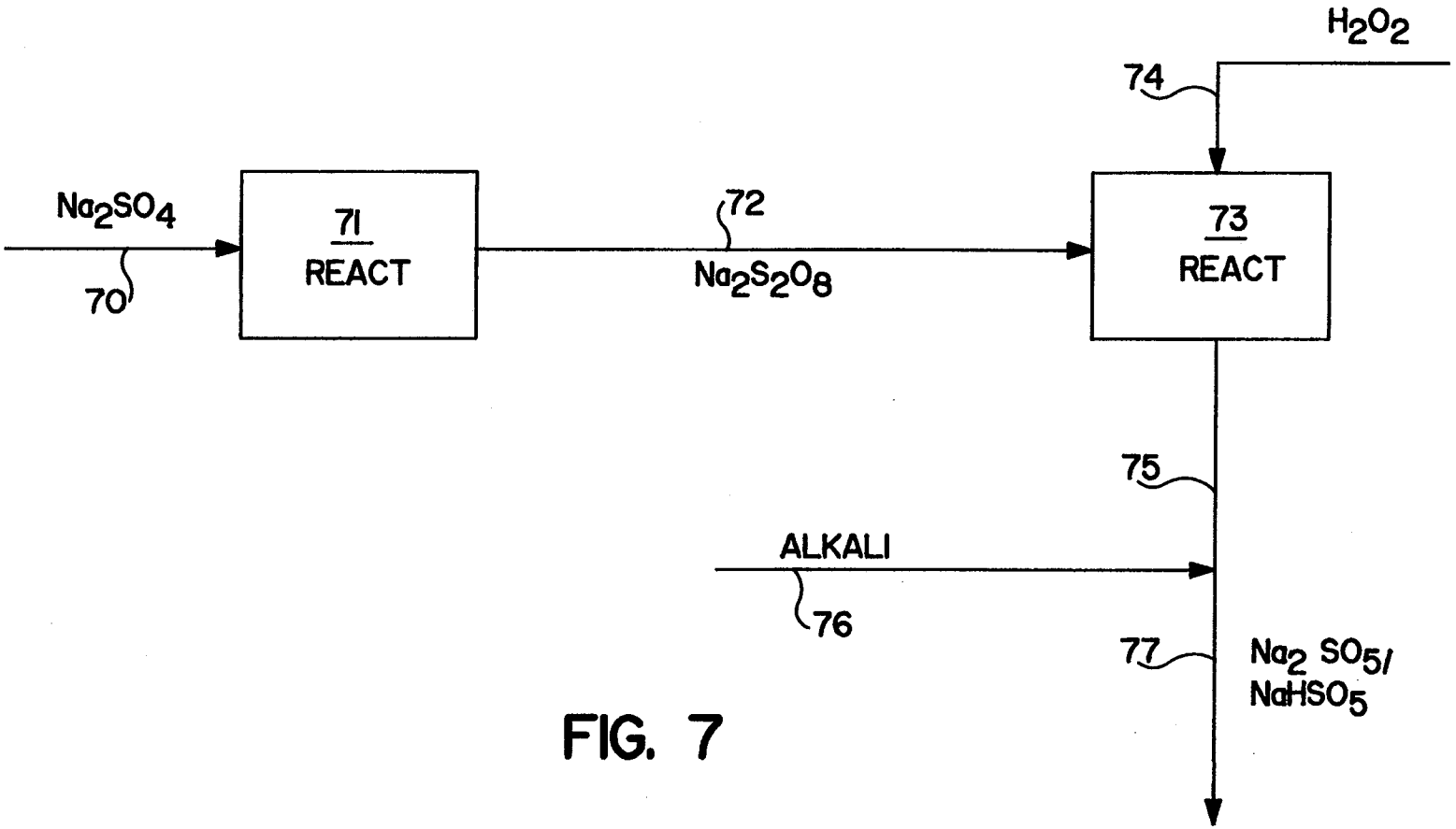

FIG. 7 is a flowsheet of the generation of monoperoxysulfate via the direct electrosynthesis of peroxydisulfate from sulfate in the reaction step of Embodiments 1, 2 and 4. Sulfate is fed in line 70 to an electrochemical reactor 71 where it is converted directly to peroxydisulfate according to U.S. Pat. No. 4,144,144 or the like. The peroxydisulfate is transferred by line 72 to the chemical reactor 73 where it reacts with peroxide in the presence of sulfuric acid in line 74 to form monoperoxysulfuric acid. The monoperoxysulfuric acid in line 75 may subsequently be neutralized by an alkali, such as sodium or calcium hydroxide, in line 76 and delivered by line 77 to the Activated Oxygen bleach step.

Embodiment 8

Figure 8:
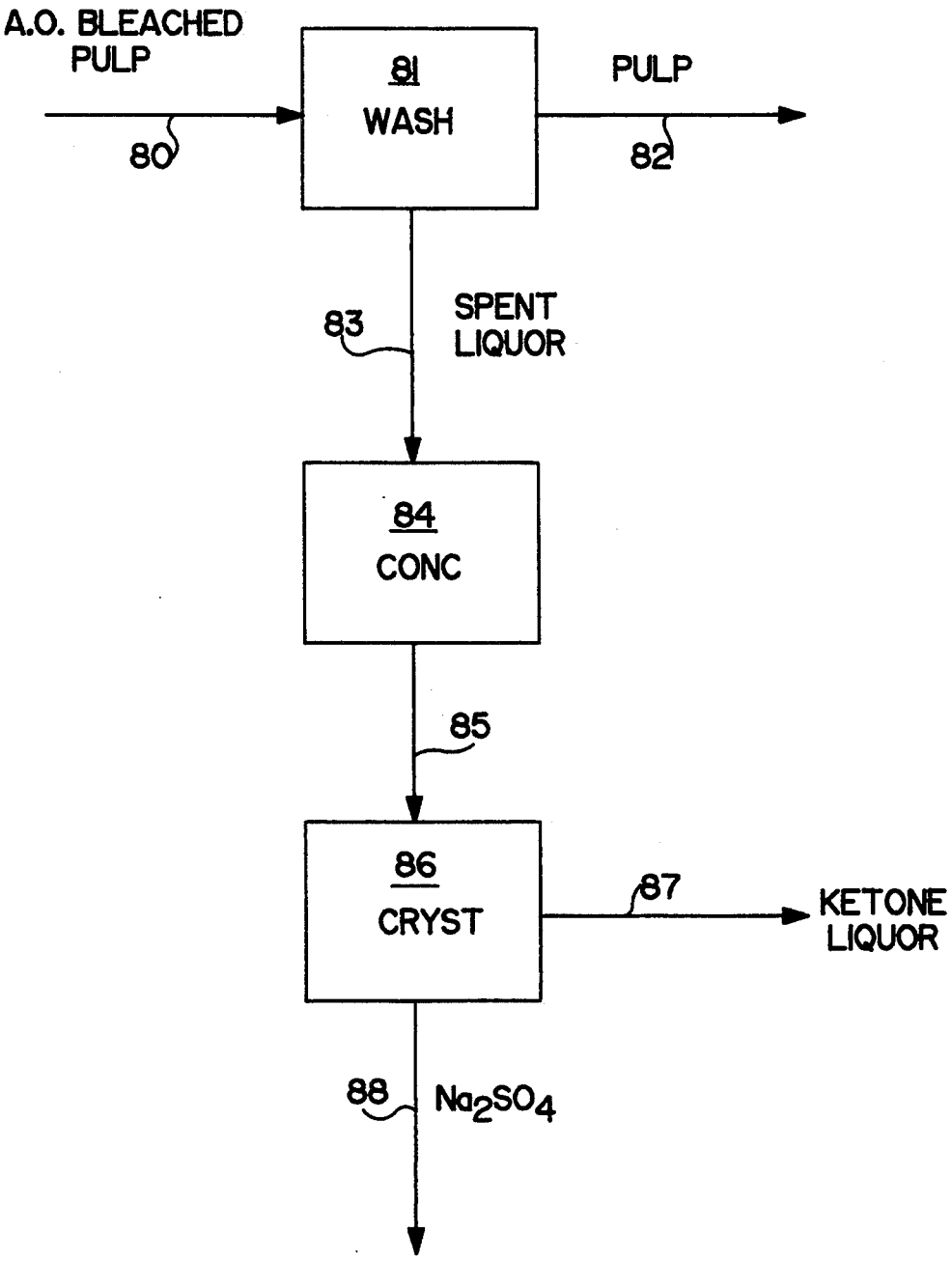

FIG. 8 is a flowsheet of sulfate recovery from the spent Activated Oxygen bleaching liquor incorporating a crystallization step, such as that indicating in step 45 of Embodiment 4. The Activated-oxygen-bleached pulp in line 80 is fed to an evaporator 81 where spent bleaching liquor is displaced into line 83. Evaporator 81 may be a press or a filter/washer. The pulp is discharged in line 82. The spent liquor in 83 is optionally sent to a concentration unit 84 and hence by line 85 to a crystallization unit 86, or the liquor is sent by line 89 to the crystallization unit 86. Concentration unit 84 may be an evaporator in which some ketone is separated from the liquor. Crystallization can be accomplished, for example, by cooling the liquor from line 85 or 89. The crystallized sulfate is separated into line 88 and the remaining ketone containing liquor is delivered by line 87.

The reactants preferably comprise a ketone or an aldehyde and an oxygen donor in proportions suitable to produce a water-soluble dioxirane which has a molecular diameter of less than 140, preferably less than about 50, angstrom units. Such a molecular diameter allows the dioxirane to make proper contact with the pulp by allowing the dioxirane to permeate the pores of the pulp.

The ketone and the aldehyde may be aliphatic or aromatic. An appropriate ketone is acetone. An appropriate aldehyde is acetaldehyde. A preferred dioxirane is dimethyldioxirane.

The pulp bleached with dioxirane and other non-chlorine-containing compounds preferably contains less than 120 parts per million (ppm) of chlorine element content, has a viscosity of at least 20 mPa.s and a brightness of at least about 70% Elrepho. In a particularly preferred embodiment, the dioxirane-treated pulps have a Kappa number of less than 10, e.g., about 4, a viscosity of at least 20 mPa.s and a brightness of at least about 70% Elrepho.

In our process aspect, the invention is a process of bleaching a chemical pulp that comprises mixing the pulp with reactants able to generate a dioxirane within the pulp. In this process aspect, the reactants preferably comprise a ketone or an aldehyde and an oxygen donor in proportions suitable to produce a water-soluble dioxirane which has a molecular diameter of less than about 50 angstrom units. The ketone may be aliphatic or aromatic, as may the aldehyde. Acetone is the preferred ketone and acetaldehyde is the preferred aldehyde. Preferably, the aldehyde or ketone is acetone, which is added in the amount of at least 4% by weight based on oven-dried pulp.

The ketone or the aldehyde may be impregnated into a pulp slurry followed by application of the oxygen donor. Alternatively, the ketone or the aldehyde and the oxygen donor are applied simultaneously to the pulp.

The oxygen donor is preferably a monoperoxysulfate. However, other suitable oxygen donors include peroxymonocarbonate, peracetic acid, perbenzoic acid perboric acid and perphosphoric acid.

The oxygen donor may be added to the pulp in a series of stages. It may be added in powdered form into the pulp slurry or in solution in which the donor can be dissolved in an aqueous buffer solution of controlled pH.

The pH of the pulp slurry may be within the range from 6.5 to 8, preferably about 7.2. Adjustment of the pH can be carried out by the addition of, for example, sodium bicarbonate, sodium carbonate, sodium hydroxide, sodium acetate or other appropriate buffers.

The pulp may be at a consistency in the range from 3 to 35%, preferably about 12%.

The temperature of the process may be in the range from 5° to 80° C., preferably from 20° to 50° C. The time required for the treatment is in the range of 5 to 90 minutes, preferably about 30 minutes.

The pulps of the present invention can be further treated by a subsequent caustic extraction. The caustic charge, usually of sodium hydroxide, may vary from between 1 to 5% based on the weight of oven-dried pulp and is preferably about 2%. The dioxirane bleaching may be carried out in combination with, either before or after, oxygen delignification.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire disclosures of all applications, patents and publications, cited above and below, are hereby incorporated by reference.

Example 1

Hemlock pulp, sample 1, produced by a kraft process to a Kappa number of 31.5 was treated with in-situ-generated dioxirane ($DMD_{isg}$) by impregnating the pulp slurry with acetone, 16% on oven-dried pulp, for 10 minutes before the addition of the powdered form of monoperoxysulphate at an active oxygen charge of 0.9% on oven-dried pulp at 25° C. for 30 minutes. The pulp consistency in the said in-situ-dioxirane bleaching stage was 13.6%. This in-situ-dioxirane treated pulp was further extracted with 3.0% sodium hydroxide charge on oven-dried pulp at 74° C. and 12% pulp consistency for two hours.

Example 2

A second sample of the same unbleached hemlock pulp of Example 1 was oxygen-delignified ($0_2$). The pulp was heated to 110° C., followed by the addition of sodium hydroxide, 1.8% charge on oven-dried pulp, and magnesium sulphate, 0.75% charge on oven-dried pulp before the introduction of oxygen at a pressure of 90 psig. The resulting pulp slurry at a 10% pulp consistency was kept under these conditions for 30 minutes.

Example 3

A third sample of the same unbleached hemlock pulp of Example 1 was bleached by a conventional chlorination stage using 3.0% available chlorine on oven-dried pulp at 20° C. and 3% pulp consistency for one hour. The resulting chlorinated pulp was subsequently extracted, using 2.0% sodium hydroxide charge on oven-dried pulp at 74° C. and 12% pulp consistency for two hours.

The results, listed in Table 1, illustrate that the in-situ-dioxirane treatment is substantially more effective on Kappa number reduction than oxygen delignification at about the same level of viscosity drop. The viscosity of the in-situ-dioxirane treated pulp has been maintained at a level close to that of the pulp bleached via a conventional CE bleaching sequence at about the same level of Kappa number reduction.

TABLE 1

Kappa number and viscosity of the pulps bleached by in-situ-dioxirane treatment, oxygen delignification, and a conventional CE sequence

| Pulp Identity | Hemlock Pulp | Act. Oxy. (% od pulp) | Kappa Number | Degree of Delig. (%) | Viscosity (mPa.s) |
|---|---|---|---|---|---|
| | Unbleached | | 31.5 | 0 | 33.5 |
| Ex. 1 | $DMD_{isg}$-E-Bleached | 0.9 | 13.7 | 57 | 26.0 |
| Ex. 2 | $O_2$—Delig. | | 22.1 | 30 | 23.2 |
| Ex. 3 | CE-Bleached | | 13.6 | 57 | 28.5 |

Example 4

A fourth sample of the unbleached hemlock pulp of Example 1 was treated with the in-situ-generated dioxirane. An aliquot of this in-situ-generated dioxirane treated hemlock pulp was further extracted with a 3.0% sodium hydroxide charge on oven-dried pulp under the exact conditions employed in Example 1.

The results, shown in Table 2, demonstrate that the in-situ-generated dioxirane reacts with the residual lignin in kraft pulp in a way similar to elemental chlorine and renders the residual lignin more soluble in dilute alkali; hence, the caustic extraction reduces the residual lignin content even further.

TABLE 2

Further Kappa number reduction achieved in the caustic extraction stage following the said in-situ-dioxirane treatment.

| Pulp Identity | Hemlock Pulp | Act. Oxy. (% od pulp) | Kappa Number | Degree of Delig. (%) | Viscosity (mPa.s) |
|---|---|---|---|---|---|
| | Unbleached | | 31.5 | 0 | 33.5 |
| Ex. 4 | $DMD_{isg}$-Treated | 0.9 | 20.6 | 35.0 | 28.3 |
| Ex. 4 | $DMD_{isg}$-E-Bleached | | 13.7 | 57.0 | 26.0 |

Example 5

A first sample of the oxygen-delignified hemlock pulp prepared as described in Example 2 was treated with in-situ-generated dioxirane at an 0.9% active oxygen charge on oven-dried pulp at 25° C. and 13.6 pulp consistency for 30 minutes. An aliquot of this in-situ-generated dioxirane treated hemlock pulp was further delignified by caustic extraction using 20% sodium hydroxide charge on oven-dried pulp at 74° C., and 12% pulp consistency for two hours.

Example 6

A fifth sample of the unbleached hemlock pulp of Example 1 was treated with in-situ-generated dioxirane at an 0.9% active oxygen charge on oven-dried pulp at 25° C. and 13.6% pulp consistency for 30 minutes. An aliquot of this in-situ-dioxirane treated hemlock pulp was further delignified by an $E_o$ extraction stage at 2.0% sodium hydroxide charge and 0.5% magnesium sulphate charge respectively on oven-dried pulp. This $E_o$ stage was carried out at 12% pulp consistency and 60° C. for 40 minutes. The oxygen pressure was kept at 20 psig for the first 10 minutes and then reduced to atmospheric pressure.

The results, shown in Table 3, demonstrate that the in-situ-dioxirane treatment in combination with oxygen delignification can reduce the residual lignin content to more than 50% in Kappa number reduction while retaining satisfactory viscosity in the bleached pulps.

TABLE 3

Kappa number and viscosity of the bleached hemlock pulps employing a combination of in-situ-dioxirane treatment and oxygen delignification.

| Pulp Identity | Hemlock Pulp | Act. Oxy. (% od pulp) | Kappa Number | Degree of Delig. (%) | Viscosity (mPa.s) |
|---|---|---|---|---|---|
| | Unbleached | | 31.5 | 0 | 33.5 |
| Ex. 2 | $O_2$—Delig. | | 22.1 | 30.0 | 23.2 |
| Ex. 5 | $O_2$-$DMD_{isg}$-Bleached | 0.9 | 12.6 | 60.0 | 21.0 |
| Ex. 5 | $O_2$-$DMD_{isg}$-E-Bleached | 0.9 | 8.0 | 75.0 | 19.0 |
| Ex. 6 | $DMD_{isg}$-Treated | 0.9 | 20.6 | 35.0 | 28.3 |
| Ex. 6 | $DMD_{isg}$-$E_o$-Bleached | 0.9 | 14.2 | 55.0 | 25.3 |

Example 7

A sixth sample of the hemlock pulp of Example 1 treated with in-situ-generated dioxirane at 2.7% active oxygen on oven-dried pulp was followed by a caustic extraction using 3.23% sodium hydroxide charge on oven-dried pulp. Both treatments were carried out under the same conditions as described in Example 1 and the resulting pulp was further bleached to a brightness of 90 % Elrepho via a conventional DED sequence. The chlorine dioxide treatment was carried out at 1% available chlorine charge on oven-dried pulp for each D stage, 6% pulp consistency, and 74° C. for three hours. The caustic extraction was achieved at 1% sodium hydroxide charge on oven-dried pulp, 74° C., and 12% pulp consistency for two hours.

Example 8

A seventh sample of the same hemlock pulp of Example 1 was bleached to a brightness of 90.1% Elrepho by a conventional $CE_1D_1E_2D_2$ process. Chlorination was carried out at 6.0% available chlorine on oven-dried pulp, 20° C., and 3% pulp consistency for one hour; chlorine dioxide treatments, $D_1$ and $D_2$ both used 1% available chlorine charge on oven-dried pulp, were carried out at 74° C. and 6% pulp consistency for three hours; caustic extractions, $E_1$ and $E_2$ were accomplished by using 3.6% and 1.0% sodium hydroxide charges for $E_1$ and $E_2$ respectively, were carried out at 74° C. and 12% pulp consistency for two hours for each stage.

Example 9

A second sample of the same oxygen-delignified hemlock pulp described in Example 2 was further bleached to a brightness of 91.8% Elrepho via $CE_1D_1E_2D_2$. Where the conditions for the conventional $CE_1D_1E_2D_2$ were the same as those applied to Example 8 with 4.8%, 1.0%, and 1.0% available chlorine charges on oven-dried pulp for the order of C, $D_1$, and $D_2$ stages and 2.88% and 1.0% sodium hydroxide charges on oven-dried pulp for $E_1$ and $E_2$ respectively.

A complete replacement of elemental chlorine in the bleaching of chemical pulps to the brightness 90% Elrepho, which satisfies market pulp specifications, was achieved by the invention bleaching sequence, $DMD_{isg}$-EDED. The strengths of the pulp produced by the invention bleaching process are identical to those of a pulp bleached by conventional beaching processes such as CEDED and OCEDED shown in Table 4.

TABLE 4

Optical and strength properties of pulps bleached by the in-situ-dioxirane treatment of the invention and conventional processes

| Pulp Properties | $DMD_{isg}$-EDED (Ex. 7) | CEDED (Ex. 8) | $O_2$CEDED (Ex. 9) |
|---|---|---|---|
| Brightness (% Elrepho) | 90.9 | 90.1 | 91.8 |
| Burst Index (kPa · $m^2$/g) | 2.4 | 2.5 | 2.2 |
| Tensile Index (N ·m/g) | 32.2 | 33.2 | 29.5 |
| Tear Index (mN · $m^2$/g) | 19 | 18 | 19 |
| Zero-Span Tensile (km) | 14.2 | 15.1 | 14.0 |
| Bulk ($cm^3$/g) | 2.01 | 2.06 | 1.97 |

Example 10

An eighth sample of the same unbleached hemlock pulp of Example 1 was treated with in-situ generated dioxirane by multiple addition of monoperoxysulphate on acetone—impregnated pulp. The overall active oxygen charge, 0.9% on oven-dried pulp, was divided into three portions, 0.25%, 0.25%, and 0.45% and added in order at twenty-minute intervals. The overall time for the in-situ-dioxirane treatment was one hour. An aliquot of this in-situ-dioxirane treated hemlock pulp was further extracted using a 3% sodium hydroxide charge on oven-dried pulp at 74° C. and 12% pulp consistency for two hours.

Example 11

A third sample of the same oxygen-delignified hemlock pulp as described in Example 2 was treated with in-situ-generated dioxirane by multiple additions of active oxygen charge on oven-dried pulp. An aliquot of the in-situ-dioxirane treated hemlock pulp was then extracted with a 3% sodium hydroxide charge on oven-dried pulp under the exact conditions employed in Example 10.

The results, shown in Table 5, illustrate that the single and multiple modes of the addition of monoperoxysulphate are equally effective in Kappa number reduction at the same active oxygen charge during the said in-situ-dioxirane treatment and caustic extraction stages.

TABLE 5

Kappa number and viscosity of hemlock pulps bleached by single or multiple addition modes of active oxygen in the in-situ-dioxirane treatment

| Pulp Identity | Hemlock Pulp | Act. Oxy. (% od pulp) | Kappa Number | Degree of Delig. (%) | Viscosity (mPa.s) |
|---|---|---|---|---|---|
| | Unbleached | | 31.5 | 0 | 33.5 |
| Ex. 1 | $DMD_{isg}$ (single mode) | 0.9 | 20.6 | 35.0 | 28.3 |
| Ex. 1 | $DMD_{isg}$-E (single mode) | 0.9 | 13.7 | 57.0 | 26.0 |
| Ex. 10 | $DMD_{isg}$ (mult. modes) | 0.9 | 21.0 | 33.3 | 27.0 |
| Ex. 10 | $DMD_{isg}$-E (mult. modes) | 0.9 | 14.5 | 54.0 | 25.1 |
| Ex. 2 | $O_2$— Delig. | | 22.1 | 30.0 | 23.2 |
| Ex. 5 | $O_2$-$DMD_{isg}$ (single mode) | 0.9 | 12.6 | 60.0 | 21.0 |
| Ex. 5 | $O_2$-$DMD_{isg}$-E (single mode) | 0.9 | 8.0 | 75.0 | 19.0 |
| Ex. 11 | $O_2$-$DMD_{isg}$ (mult. modes) | 0.9 | 13.1 | 58.4 | 20.6 |
| Ex. 11 | $O_2$-$DMD_{isg}$-E (mult. modes) | 0.9 | 8.1 | 74.3 | 18.2 |

Example 12

A ninth sample of the unbleached hemlock pulp of Example 1 was delignified via multistage in-situ-dioxirane treatments and caustic extractions such as $DMD_{isg1}$-$E_1$-$DMD_{isg2}$-$E_2$. The in-situ-dioxirane treatments were carried out at 0.45% active oxygen charge on oven-dried pulp at each stage, 25° C., and 13.6% pulp consistency for 30 minutes and the caustic extractions were performed at 2% sodium hydroxide charge on oven-dried pulp at each stage, 74° C., and 12% pulp consistency for two hours.

Example 13

A fourth sample of the same oxygen-delignified hemlock pulp of Example 2 was bleached via exactly the same multistage sequence as that employed for the Example 12.

The results, shown in Table 6, demonstrate that multistage treatment of the said in-situ-dioxirane treatment followed by caustic extraction is slightly more effective in the reduction of Kappa number compared to a single stage treatment at the same active oxygen charge on oven-dried pulp. This multistage treatment of the unbleached hemlock pulp employing the said in-situ-dioxirane treatment followed by caustic extraction effectively delignifies the hemlock pulp to more than 50% in Kappa number reduction while the viscosity of the treated pulp is retained above 20 mPa.s. However, in the case of the oxygen-delignified hemlock pulp bleached by a multistage treatment via in-situ-dioxirane treatment and caustic extraction, a major loss of pulp viscosity evidently occurred during the oxygen delignification stage.

TABLE 6

Kappa number and viscosity of hemlock pulps bleached via single-stage or multi-stage in-situ-dioxirane treatment and caustic extraction

| Pulp Identity | Hemlock Pulp | Act. Oxy. (% od pulp) | Kappa Number | Degree of Delig. (%) | Viscosity (mPa.s) |
|---|---|---|---|---|---|
| | Unbleached | | 31.5 | 0 | 33.5 |
| Ex. 1 | $DMD_{isg}$-E Bleached | 0.9 | 13.7 | 57.0 | 26.0 |
| Ex. 12 | $DMD_{isg1}E_1$ $DMD_{isg2}E_2$ Bleached | 0.9 | 13.3 | 58.0 | 23.1 |
| Ex. 2 | $O_2$— Delig. | | 22.1 | 30.0 | 23.2 |
| Ex. 5 | $O_2$-$DMD_{isg}$E Bleached | 0.9 | 8.0 | 75.0 | 19.0 |
| Ex. 13 | $O_2$-$DMD_{isg1}E_1$ $DMD_{isg2}E_2$ | 0.9 | 7.5 | 76.2 | 15.5 |

Example 14

A tenth sample of the same unbleached hemlock pulp of Example 1 was treated with in-situ-generated dioxirane under the exact conditions employed in Example 1 except that the charge of acetone, (16% on oven-dried pulp used in Example 1), was 4%.

The increase in the acetone charge from 4 to 16% on oven-dried pulp resulted in a 24% increase in Kappa number reduction during the DMD-E bleaching. The degree of delignification depends on the quantity of dioxirane generated in the pulp slurry by the reaction of acetone with monoperoxysulphate.

TABLE 7

Kappa number and viscosity of the hemlock pulps bleached via $DMD_{isg}$-E process using various acetone charges in the $DMD_{isg}$ treatment.

| Hemlock Pulp | Act. Oxy. (% od pulp) | Acetone Ch. (% od pulp) | Kappa Number | Deg. of Delig. (%) | Viscosity (mPa.s) |
|---|---|---|---|---|---|
| Unbleached | | | 31.5 | 0.0 | 33.5 |
| $DMD_{isg}$-E Bleached (Ex. 14) | 0.9 | 4 | 17.2 | 45.0 | 26.0 |
| $DMD_{isg}$-E Bleached (Ex. 1) | 0.9 | 16 | 13.7 | 57.0 | 26.0 |

Example 15

An eleventh sample of the unbleached hemlock pulp of Example 1 was delignified via the in-situ-dioxirane treatment followed by caustic extraction. Conditions in both stages were the same as those described in Example 7. An aliquot of the $DMD_{isg}$-E- bleached hemlock pulp was further bleached with hydrogen peroxide using 1.88% available oxygen charge (calculated as one available oxygen per hydrogen peroxide molecule) on oven-dried pulp. Sodium hydroxide, 2.5%, sodium silicate, 3%, and magnesium sulphate, 0.5%, on oven-dried pulp were added in the hydrogen peroxide treatment (P) which was carried out at 60° C. and 14% pulp consistency for one hour and forty minutes.

Example 16

An aliquot of the hemlock pulp from Example 11 was bleached by hydrogen peroxide using 1.88% available oxygen charge on oven-dried pulp under the same conditions described for the eleventh sample of Example 15.

Both in-situ-dioxirane treated hemlock pulps with or without oxygen delignification can be bleached to a brightness of more than 70% Elrepho without the use of chlorine-containing compounds, as shown in Table 8.

TABLE 8

Kappa number, viscosity, and optical property of the hemlock pulps bleached via in-situ-dioxirane treatment, oxygen delignification, and caustic extraction without the use of chlorine-containing compounds

| Pulp Identity | Hemlock Pulp | Kappa Number | Viscosity (mPa.s) | Brightness (% Elrepho) |
|---|---|---|---|---|
| | Unbleached | 31.5 | 33.5 | 24.4 |
| Ex. 15 | $DMD_{isg}$-E-Bleached | 5.4 | 21.0 | 54.1 |
| Ex. 15 | $DMD_{isg}$-E-P-Bleached | 4.0 | 21.0 | 71.0 |
| Ex. 2 | $O_2$—Delig. | 22.1 | 23.2 | 27.7 |
| Ex. 11 | $O_2$-$DMD_{isg}$-E-Bleached | 8.1 | 18.2 | 47.6 |
| Ex. 16 | $O_2$-$DMD_{isg}$-E-P-Bleached | 4.8 | 11.2 | 71.0 |

Example 17

A sample of aspen kraft pulp was treated with in-sit-generated dioxirane at 2.7% active oxygen and 32% acetone charges on oven-dried pulp at 25° C. and 13.6% pulp consistency for 30 minutes. An aliquot of the in-situ-dioxirane treated aspen pulp was extracted at 0.45% sodium hydroxide charge on oven-dried pulp at 74° C. and 12% pulp consistency for three hours and then further bleached with hydrogen peroxide using 0.94% available oxygen, 2.5% sodium hydroxide, 3% sodium silicate, 0.5% magnesium sulphate on oven-dried pulp at 60° C. and 14% pulp consistency for one hour and forty minutes.

Example 18

A second sample of the same aspen kraft pulp was oxygen-delignified using 1% sodium hydroxide and 0.5% magnesium sulphate on oven-dried pulp, and 100 psig oxygen pressure at 100° C. and 12% pulp consistency for 40 minutes. This oxygen-delignified aspen kraft pulp was then treated with in-situ-generated dioxirane at 0.9% active oxygen and 8% acetone charges on oven-dried pulp at 25° C. for 30 minutes. An aliquot of the oxygen-delignified and in-situ-dioxirane treated aspen pulp was extracted and further bleached with hydrogen peroxide using 0.94% available oxygen on oven-dried pulp under exactly the same conditions employed in Example 17.

The results, shown in Table 9, demonstrate that in-situ-dioxirane treatment is effective in delignifying aspen kraft pulp while retaining good viscosity and strength properties.

TABLE 9

Strength and optical properties of the aspen kraft pulps bleached via in-situ-dioxirane treatment, oxygen delignification, and conventional bleaching process

| Aspen Pulp | Kappa Number | Degree of Delig. (%) | Zero-Span Tensile (km) | Viscosity (mPa.s) | Brightness (% Elrepho) |
|---|---|---|---|---|---|
| Unbleached | 16.4 | 0.0 | 16.3 | 50.5 | 40.6 |
| $DMD_{isg}$-Treated (Ex. 17) | 2.3 | 86.0 | 18.5 | 34.1 | 76.8 |
| $DMD_{isg}$-E-P-Bleached (Ex. 17) | — | — | 16.8 | 19.2 | 86.7 |
| $O_2$—Delig. (Ex. 18) | 11.5 | 30.0 | 14.5 | 43.6 | 50.1 |
| $O_2$-$DMD_{isg}$-Bleached (Ex. 18) | 3.7 | 77.4 | 15.7 | 30.1 | 71.6 |
| $O_2$-$DMD_{isg}$-E-P, Bleached (Ex. 18) | — | — | 15.5 | 18.9 | 85.4 |

The process of the present invention is applicable to pulps produced by kraft, sulphite, soda-AQ, organosol or other processes from softwood or hardwood species. The lignocellulosic materials may be processed to have residual lignin contents equivalent to 20 to 40 and 8 to 25 Kappa numbers for softwood and hardwood respectively.

The process of the present invention, is able to bleach a pulp to a brightness of above 90% Elrepho without the use of elemental chlorine and to a brightness of above 70% Elrepho without the use of any chlorine containing compounds, for example, the sequence combining all or several of the following bleaching stages, namely caustic extraction, treatment according to the present invention with a dioxirane generated in situ, oxygen delignification, hydrogen peroxide treatment, ozone treatment, or other bleaching stages using chlorine-free compounds. The pulps produced are bleached pulps of a desirable brightness level with strength properties comparable to those of pulps produced by a conventional CEDED process and superior to those pulps produced via extensive oxygen delignification.

Acetone is exemplified but the dioxiranes can be generated by contacting a range of ketones and aldehydes with oxygen donors. The oxygen donors can be inorganic or organic compounds which give off one or more oxygen atoms during the reaction. They are, for example, monoperoxysulfate, peroxymonocarbonate, and peracetic, perbenzoic, perboric, and perphosphoric acid and their derivatives. The in situ-dioxirane treatment can be applied in any sequences with oxygen delignification, caustic extraction, hydrogen peroxide bleaching, ozone treatment, chlorine dioxide treatment, and other conventional bleaching sequences.

Example 1A-Reactants Recycle

An unbleached hemlock kraft pulp of 31.5 Kappa number was bleached by the invention employing 0.9% Active Oxygen (AO) charge on oven-dried pulp, calculated by one activated oxygen atom per molecule of monoperoxysulfate, and 4.9% acetone charges respectively at 25° C. and 13.6% pulp consistency for 45 minutes. At the end of bleaching stage, an aliquot of the bleachery was collected by filtration and subsequently analyzed for acetone by gas chromatography and for sulfate by an analytical method. Results showed 95% and 90% recoveries for acetone and sulfate, a by-product from the oxygen donor, $KHSO_5$, respectively based on the initial chemical charges.

Example 2A-Reactants Recycle

Fifty grams of 95% sodium peroxydisulfate ($Na_2S_2O_8$) were dissolved in 60° C. water to make up a 100 mL solution. The $Na_2S_2O_8$ was dissolved quickly and the temperature dropped steadily to 45° C. Sulfuric acid (98% by weight, 24.4 g) was added to the peroxydisulfate solution slowly with stirring. The resulting solution was stirred for 30 minutes and then cooled to 20° C. with ice water bath. Sodium hydroxide (50% by weight) was used to adjust the pH of the monoperoxysulfuric acid solution to 1.5. The yield of monoperoxysulfate was 66% based on peroxydisulfate. The freshly generated monoperoxysulfate was used to bleach a Canadian mixed softwood oxygen-delignified kraft pulp at 1.0% AO and 5.0% acetone charges. The Kappa number of this pulp was decreased from 14.5 to 6.8 (53% Kappa reduction).

Example 3A-Reactants Recycle

A mixture of fifty grams of 95% sodium peroxydisulfate ($Na_2S_2O_8$), eighteen grams of 70% $H_2O_2$ and two grams of 98% $H_2SO_4$ was heated to 100°-110° C. and was kept at that temperature for five minutes. The reaction mixture was then cooled to room temperature and diluted with 300 mL of deionized water. The resulting solution was then neutralized to pH 1.2 using sodium hydroxide (50% by weight). The yield of monoperoxysulfate was 50% based on peroxydisulfate. The freshly generated monoperoxysulfate was used to bleach the same kraft pulp as in Example 2 using 1.0% AO and 5.0% acetone charges at 13.6% pulp consistency and 25° C. for 45 minutes. The Kappa number of this pulp was deceased from Kappa 14.5 to 6.8 (53% Kappa reduction).

Example 4A-Reactants Recycle

Sulfuric acid (98% by weight, 150.3 g) was added dropwise to hydrogen peroxide (70% by weight, 48.6 g) placed in a 500 mL flask with vigorous stirring. The temperature of the reaction mixture was kept at 25°-30° C. by a ice water bath. The resulting mixture was stirred for another 20 minutes after the complete addition of the sulfuric acid. The resulting solution as then diluted with 300 mL of deionized water at 20°-30° C. The monoperoxysulfuric acid solution was then neutralized to pH 1.2 using sodium hydroxide (50% by weight). The yield of monoperoxysulfate was 70% based on hydrogen peroxide. The freshly generated monoperoxysulfate was used to bleach the same kraft pulp as in Example 2A using 1.0% AO and 5.0% acetone charges at 13.6% pulp consistency and 25° C. for 45 minutes. As a result, the Kappa number of the pulp was decreased from 14.5 to 6.0 (59% Kappa reduction).

Example 5A-Reactants Recycle

Four hundred and fifty mL of spent Activated Oxygen bleaching liquor were separated from the bleached pulp by compression and collected via a lab press. The concentration of acetone in the solution was 6.84 g/L. Distillation of a 150 mL sample of this solution for two hours resulted in 76 mL of clear distillate. The acetone content of the distillate was 11.7 g/L. The efficiency of acetone recovery from pressate by distillation was 87%.

Example 6A-Reactants Recycle

Monoperoxysulfuric acid was prepared by the same procedure as in Example 4A using hydrogen peroxide (70% by weight, 9.72 g) and sulfuric acid (98% by weight, 30 g). The freshly generated monoperoxysulfuric acid was neutralized by calcium hydroxide (12.5% by weight) to a pH of 0.5. Calcium sulfate was immediately precipitated from the solution and was filtered off. There was no monoperoxysulfate detectable in the separated white precipitate. The freshly generated monoperoxysulfate was used to bleach the same kraft pulp as in Example 2A using 1.0% AO and 5.0% acetone charges at 13.6% pulp consistency and 40° C. for 60 minute. The Kappa number of the pulp was decreased from 14.5 to 5.1 (65% Kappa reduction).

Example 7A-Reactants Recycle

The spent ketone containing liquor, containing specifically acetone used in this Example, was separated from a batch of Activated Oxygen bleached pulp by compression of the pulp in a laboratory press. The recovered spent bleaching liquor was used to give 70% of the total acetone required in Activated Oxygen bleaching. The same recycle procedure was repeated five times in bleaching consecutive batches of Canadian mixed softwood oxygen-delignified kraft pulp using Activated Oxygen at 0.9% AO and 4.9% acetone charges, 13.6% pulp consistency and 25° C. for 45 minutes. The Activated Oxygen bleaching was effective even after the fifth recycle of acetone, as illustrated in Table 1.

TABLE 1

Kappa number of oxygen-delignified softwood kraft pulps bleached by Activated Oxygen using spent Activated Oxygen bleaching liquor as recycled acetone for 70% of the total acetone required.

| | Pure Acetone | Number of Recycle Using 70% Recycled Acetone and 30% Pure Acetone | | | | |
|---|---|---|---|---|---|---|
| | | 1 | 2 | 3 | 4 | 5 |
| Kappa Number | 5.8 | 6.5 | 6.7 | 7.2 | 7.5 | 7.7 |

Note: Oxygen-delignified pulp, 14.5 Kappa.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for bleaching a chemical pulp which comprises the steps of (a) mixing the pulp at a pH of from 6.5 to 8 and at a temperature of from 20° to 50° C. with amounts of reactants comprising a peroxy sulfate as an oxygen donor and at least 4% by weight based on oven-dried pulp of a ketone, in proportions effective to produce in-situ an amount effective to bleach the pulp of a water-soluble dioxirane; and (b) bleaching the pulp with the dioxirane generated in-situ therein.

2. A process as claimed in claim 1 in which the ketone is aliphatic.

3. A process as claimed in claim 1 in which the ketone is acetone.

4. A process as claimed in claim 1 in which the ketone is impregnated into the pulp slurry followed by the oxygen donor.

5. A process as claimed in claim 4 in which the ketone is acetone.

6. A process as claimed in claim 1 in which the ketone compound and the oxygen donor are mixed with the pulp simultaneously.

7. A process as claimed in claim 6 in which the ketone compound is acetone.

8. A process as claimed in claim 1 in which the oxygen donor is sodium monoperoxysulfate.

9. A process as claimed in claim 1 in which the oxygen donor is added in a series of stages.

10. A process as claimed in claim 1 comprising the additional step of conducting a caustic extraction on the bleached pulp using sodium hydroxide in an amount from 0.5 to 5% by weight based on oven-dried pulp.

11. A process as claimed in claim 10 in which the dioxirane treatment and caustic extraction are conducted sequentially in a multi-stage sequence.

12. A process as claimed in claim 11 in which the bleaching sequence is $A_1$-$E_1$-$A_2$-$E_2$, wherein A and $A_2$ indicate a bleaching treatment using in-situ-generated dimethyldioxirane and $E_1$ and $E_2$ indicate a caustic extraction.

13. A process as claimed in claim 1 in which the dioxirane is generated in an amount effective to provide an active oxygen charge within the pulp of from 0.2 to 4.0% by weight based on oven-dried pulp.

14. A process as claimed in claim 1 in which the bleaching is conducted at a temperature of about 25° C.

15. A process as claimed in claim 1 in which the oxygen donor is monoperoxysulfate, the ketone is aliphatic and the bleaching step is carried out for from 5 to 90 minutes at a pulp consistency of from 3 to 35%.

16. A process as claimed in claim 15 in which the ketone is acetone.

17. A process as claimed in claim 1 in which pH of the pulp is about 7.3.

18. A process as claimed in claim 1 in which pH of the pulp is adjusted to 6.5 to 8 by the addition thereto of sodium carbonate, sodium hydroxide, sodium acetate or a buffer.

19. A process as claimed in claim 1 in which the pulp is at a consistency in the range from 3 to 35%.

20. A process as claimed in claim 1 carried out in combination with oxygen delignification, either beforehand or afterwards.

21. A process as claimed in claim 1 which comprises an additional bleaching step carried out in sequence with the dioxirane treatment.

22. A process as claimed in claim 21 in which the bleaching agent for the additional bleaching step is chlorine dioxide, hydrogen peroxide, ozone or oxygen.

23. A pulp bleaching process according to claim 1 wherein the oxygen donor generates sodium sulfate as a byproduct and which comprises the steps of recovering the sodium sulfate, converting the sulfate ion to monoperoxysulfate ion and recycling the thus-produced monoperoxysulfate to the bleaching stage as the oxygen donor.

24. A process as claimed in claim 23 in which the sodium sulfate is recovered from the bleaching effluent.

25. A process as claimed in claim 23 in which the sodium sulfate is recovered from recovery boiler precipitator catch.

26. A process as claimed in claim 23 in which monoperoxysulfate is generated by the reaction of hydrogen peroxide with sulfuric acid followed by a neutralization step or by hydrolysis of peroxydisulfate followed by a neutralization step or by the reaction of hydrogen peroxide with peroxydisulfate followed by a neutralization step.

27. A process as claimed in claim 26 in which the generated monoperoxysulfuric acid is neutralized with calcium hydroxide.

28. A process as claimed in claim 27 in which sodium monoperoxysulfate is generated from the sodium sulfate by electrolysis.

29. A process as claimed in claim 23 in which sulfuric acid and sodium hydroxide are produced via an electrodialysis of the sodium sulfate.

30. A process as claimed in claim 23 in which a bipolar membrane is employed.

31. A process as claimed in claim 23 in which the spent carbonyl ketone from the bleaching process is recovered and reused in the bleaching process.

32. A process as claimed in claim 31 in which the spent ketone from the bleaching process is recovered by gas or steam stripping or by distillation.

33. A process as claimed in claim 31 in which the spent ketone in the spent bleaching liquor is directly recirculated and reused in the bleaching process.

34. A process as claimed in claim 31 in which the sodium sulfate is separated from the spent bleaching liquor.

35. A process as claimed in claim 34 in which the sodium sulfate is separated by crystallization.

* * * * *